US008851788B2

(12) United States Patent
Rigomer

(10) Patent No.: US 8,851,788 B2
(45) Date of Patent: Oct. 7, 2014

(54) BARRIER TYPE BOLLARD

(76) Inventor: Renaud Rigomer, Combreux (FR)

( * ) Notice: Subject to any disclaimer, the term of this patent is extended or adjusted under 35 U.S.C. 154(b) by 134 days.

(21) Appl. No.: 13/518,585

(22) PCT Filed: Dec. 27, 2010

(86) PCT No.: PCT/FR2010/000874

§ 371 (c)(1),
(2), (4) Date: Jun. 22, 2012

(87) PCT Pub. No.: WO2011/080420

PCT Pub. Date: Jul. 7, 2011

(65) Prior Publication Data

US 2012/0257925 A1 Oct. 11, 2012

(30) Foreign Application Priority Data

Dec. 29, 2009 (FR) ..... 09 06379

(51) Int. Cl.
*E01F 13/00* (2006.01)
*E01F 13/12* (2006.01)

(52) U.S. Cl.
CPC ..... *E01F 13/126* (2013.01)
USPC ..... 404/6

(58) Field of Classification Search
USPC ..... 404/6, 9, 10
See application file for complete search history.

(56) References Cited

U.S. PATENT DOCUMENTS 4,342,525 A * 8/1982 Mastronuzzi, Jr. ..... 404/6
4,674,911 A * 6/1987 Gertz ..... 404/6
6,539,175 B1 * 3/2003 Geary et al. ..... 396/59
7,775,738 B2 * 8/2010 Darcy ..... 404/6
7,866,912 B2 * 1/2011 Gelfand et al. ..... 404/6
2005/0135878 A1 6/2005 McNally et al.
2006/0233607 A1 * 10/2006 Buckley et al. ..... 404/6
2009/0250674 A1 10/2009 Darcy
2010/0254760 A1 * 10/2010 Sung et al. ..... 404/10
2011/0217115 A1 * 9/2011 Thompson et al. ..... 404/6

FOREIGN PATENT DOCUMENTS

EP 0 276 504 A1 8/1988
EP 1 279 771 A2 1/2003
EP 1 964 974 A2 9/2008
WO 2005/045135 A1 5/2005

OTHER PUBLICATIONS

International Search Report, dated May 3, 2011, from corresponding PCT application.

* cited by examiner

*Primary Examiner* — Abigail A Risic
(74) *Attorney, Agent, or Firm* — Young & Thompson

(57) ABSTRACT

A barrier type bollard includes: at least two blocks 10, 20, the block 10 being defined between two faces 11, 12 defining a wedge having an edge 13 and a dihedral angle α of a value of less than ninety degrees, the face 12 being arranged as a sliding face 12', the second block 20 having a sliding face 22' substantially complementary to the sliding face 12', the two blocks 10, 20 being mounted in such a manner that their sliding faces 12' and 22' rest one on the other; an oblong element 30 of longitudinal axis 31 projecting from the face 11; and damper elements 40 for damping the sliding movement of the two blocks one on the other, the damper elements 40 being interposed between the two blocks. The bollard is applicable to impact-absorbing barriers against all kinds of body, and particularly but not exclusively, against vehicles.

12 Claims, 3 Drawing Sheets

BARRIER TYPE BOLLARD

The present invention relates to barrier type bollards for constituting barriers proper together with damping of impacts, for example, but not exclusively, for constituting devices suitable for stopping a moving body, e.g. a motor vehicle or the like, in order to make certain locations safe, e.g. premises that might be attacked by so-called "battering ram" vehicles, or to provide safety for passengers in certain vehicles, e.g. at the bottoms of hills in order to stop heavy goods vehicles after their brakes have failed, at the ends of airport runways in order to stop airplanes having difficulty in landing, etc.

BACKGROUND OF THE INVENTION

Barrier type bollards already exist, e.g. those described and shown in documents EP-A-1 279 771 and US 2005/135878 A1. However they do not give entire satisfaction, since they do not enable the above-mentioned essential objects to be achieved, i.e. stopping vehicles and damping impacts to which said vehicles are subjected.

That is why the applicant has provided a barrier type bollard that constitutes the subject matter of application EP-A-1 964 974.

SUMMARY OF THE INVENTION

That barrier bollard gives good results, in particular compared with prior art devices in this field. Nevertheless, seeking to improve the barrier bollard of his first invention, the applicant proposes making a barrier bollard of a structure that makes it even more reliable, while being lighter in weight and more compact, thereby making it easy to manufacture industrially, while also being less dangerous for people traveling in the vehicles that it seeks to stop, such as cars, aircraft on the ground, etc.

More precisely, the present invention provides a barrier type bollard comprising at least a first block and a second block;

- the first block being defined substantially between first and second faces defining a wedge with a dihedral angle having a value of less than ninety degrees, the first face being defined substantially in a first plane, the second face being arranged as a sliding face occupying a cylindrical surface;
- the second block having a face arranged as a sliding face occupying a cylindrical surface that is substantially complementary to the cylindrical surface of the first block;
- the two blocks being mounted in sliding cooperation one on the other in such a manner that their sliding faces rest one on the other;
- an oblong element defined along a first longitudinal axis; and
- means for securing said oblong element to project from the first face of the first block in such a manner that its longitudinal axis forms a non-zero angle relative to the first plane, which angle is optionally ninety degrees;

the bollard being characterized by the fact that it further includes damper means for damping the sliding movement of the two blocks one on the other, said damper means being interposed between said two blocks.

BRIEF DESCRIPTION OF THE DRAWINGS

Other characteristics and advantages of the present invention appear from the following description given with reference to the accompanying illustrative and non-limiting drawings, in which:

FIGS. 2 and 3 are side views; FIGS. 4 and 5 are perspective views; FIGS. 2 and 4 show a barrier bollard of the invention in its initial configuration, i.e. before it has acted as a barrier; FIGS. 3 and 5 show it in a configuration that it takes up after acting as a barrier, e.g. after being subjected to an impact from a battering-ram vehicle, as shown diagrammatically in FIG. 3.

DETAILED DESCRIPTION OF THE PREFERRED EMBODIMENTS

Figure 1:
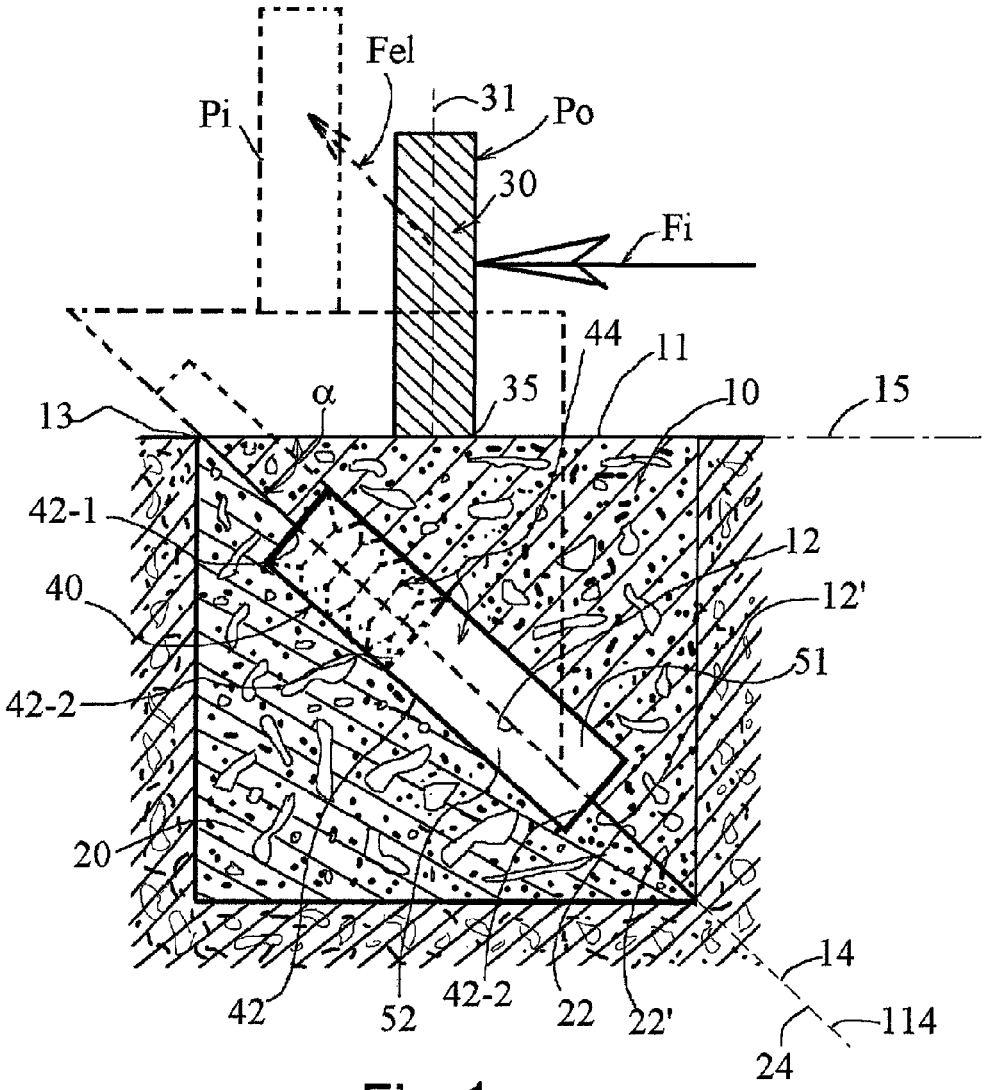
FIG. 1 is a diagrammatic cross-section view of an embodiment of a barrier type bollard of the invention.

With reference to the accompanying figures, the present invention relates to a barrier type bollard including at least a first block 10 and a second block 20.

The first block 10 is defined substantially between first and second faces 11 and 12 defining a wedge with an edge 13 that may be physically embodied or virtual, with a dihedral angle $\alpha$ having a value of less than ninety degrees, preferably equal to about forty-five degrees, the second face 12 of these first and second faces 11 and being arranged as a sliding face 12' occupying a cylindrical surface 14.

In the meaning of the present description, the term "cylindrical surface" is used to designate a surface generated by a straight line sweeping parallel to itself and running along a director line that may be of any shape: curved; broken; rectilinear; etc. In the embodiment shown, this cylindrical surface is substantially plane, and its director line is rectilinear.

The other or first face 11 substantially occupies a first plane 15, i.e. this face is generally plane in shape.

The second block 20 has a face 22 arranged as a sliding face 22' occupying a cylindrical surface 24 substantially complementary to the cylindrical surface 14 of the first block 10.

Figure 2:
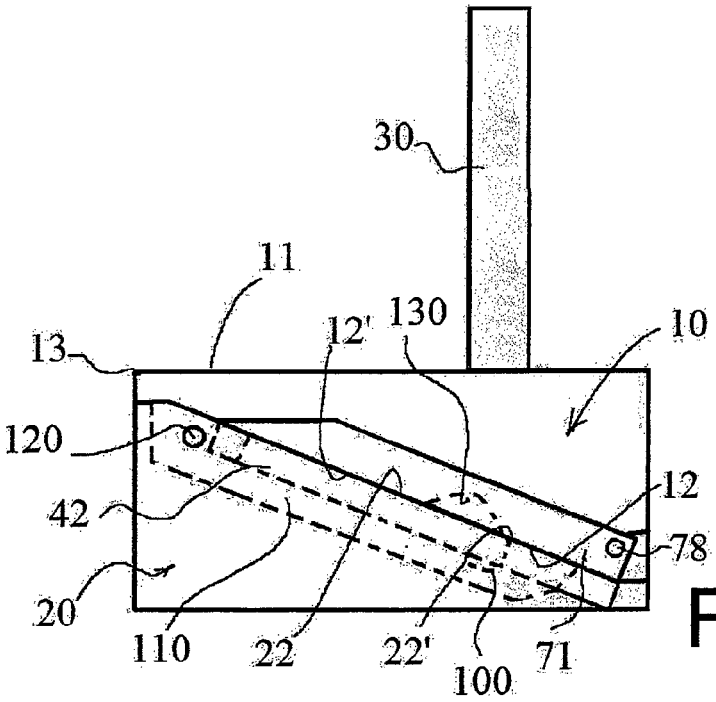
FIGS. 2 to 5 show an industrial embodiment of the barrier a bollard of the invention in accordance with FIG. 1.
Figure 3:
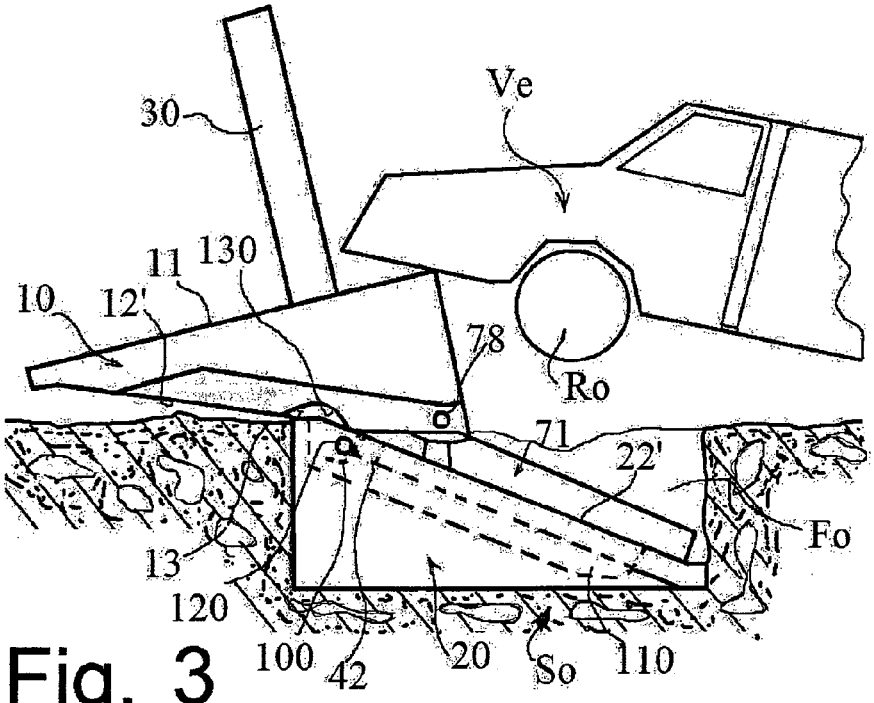
Figure 4:
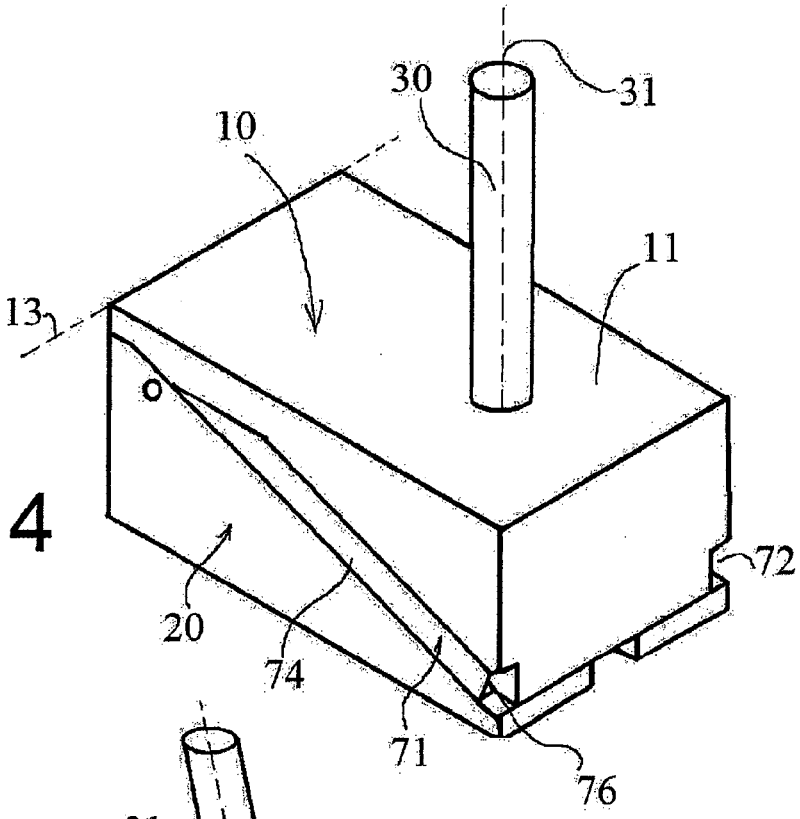
Figure 5:
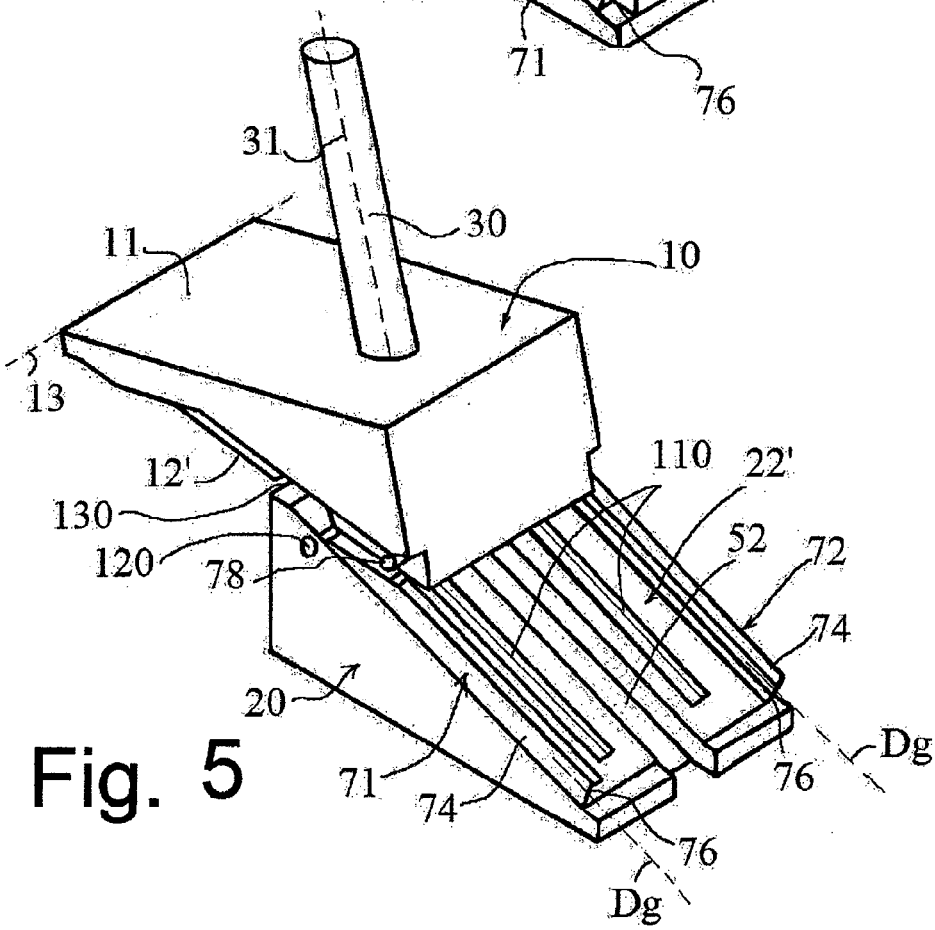

The two blocks 10 and 20 are mounted one on the other in sliding cooperation in such a manner that their respective sliding faces 12' and 22' rest one on the other. FIGS. 1, 2, and 4 show the bollard in its "initial" configuration, i.e. before it has been subjected to an impact from an article or a body such as a vehicle Ve (FIG. 3), while FIGS. 3 and 5 show the bollard in a configuration taken up after it has been subjected to an impact, as explained below.

The two blocks 10 and 20 may be made of any material presenting a certain amount of rigidity and a certain amount of strength, such as concrete or metal, or they may be constituted by metal reinforcement embedded in cast concrete. As another possibility, one of the blocks, e.g. the block 10, may be made of a material such as metal, while the other block 20 may be made of some other material, such as concrete.

The bollard also has an oblong element 30 defined along a first longitudinal axis 31 together with means 35 for securing said oblong element so that it projects from the first face 11 of the first block 10 in such a manner that its longitudinal axis 31 is at a nonzero angle relative to the first plane 15, optionally at an angle of ninety degrees, as shown in the figures.

According to an essential characteristic of the invention, the bollard also has damper means 40 for damping the sliding movement of one of the two blocks on the other.

These damper means 40 are interposed between the two blocks 10 and 20 and can be made in various ways. For example, they may be of the resilient pneumatic type having a gas, or of the hydraulic type having oil. Nevertheless, in preferred and advantageous manner, for questions of long-term reliability, according to another characteristic of the invention, the damper means 40 are irreversible.

According to a characteristic of the invention, the irreversible damper means 40 comprise a cartridge 42, a groove made along a second longitudinal axis 114 in one of the two blocks 10 and 20, the groove opening out into the sliding face 12' or 22' of the block in which it is made, and being defined in such a manner that the cartridge 42 is suitable for being embedded therein, together with means for coupling a wall 42-2, 42-1 of the cartridge with the block in which the groove is not made, said wall 42-2, 42-1 being perpendicular to the second longitudinal axis 114 when the cartridge is embedded in the groove.

In a first embodiment such as that shown in FIG. 1, the means for coupling a wall of the cartridge 42 when it is embedded in the groove 51, 52 with the block in which said groove is not made, are constituted by another groove 52, 51 made along the second longitudinal axis 114 in said other block and opening out into the sliding face of that block.

Under such circumstances, the two grooves 51 and 52 are defined in such a manner that the cartridge 42 is suitable for being embedded in both of the grooves 51 and 52, and that the total depth $P_{51}$ plus $P_{52}$ of the two grooves defined in a second plane perpendicular to the second longitudinal axis 114 lies in the range between two values equal respectively to the height H (this limit value being included in the range) of the cartridge as measured in said second plane when the cartridge is embedded in both grooves 51 and 52, and twice said a height H (this limit value not being included in the range). This characteristic may be written using the following mathematical formula:

$$H \leq P_{51} + P_{52} < 2H$$

In a second embodiment (not specifically shown but that can be deduced from the view of the embodiment described above with reference to FIG. 1), the means for coupling a wall of the cartridge 42 when it is embedded in the groove with the block in which the groove is not made may be constituted by the fact that the groove is a groove made in the second block 20 like the groove 52, but with a depth that is not less than the height H of the cartridge, while the first block 10 does not have a groove. In contrast, these coupling means also include a tab secured to the first block 10 and projecting from its sliding face 12' in such a manner, that when the bollard is in its initial configuration and the cartridge 42 is embedded in the groove, the tab extends into the groove immediately facing and in the proximity of the above-defined wall 42-2 that is the furthest from the edge 13 shown in FIG. 1.

In a third embodiment that is not specifically shown but that can be deduced from the view of the embodiment described above with reference to FIG. 1, the means for coupling a wall of the cartridge 42 when it is embedded in the groove with the block in which said groove is not made, are constituted by the fact that the groove is a groove made in the first block 10 like the groove 51, but having a depth that is not less than the height H of the cartridge, and that the second block 20 does not have a groove. In contrast, these coupling means also include a tab secured to the second block 20 and projecting from its sliding face 22' in such a manner, that when the bollard is in its initial configuration and the cartridge 42 is embedded in the groove, said tab extends into the groove immediately facing and in the proximity of the above-defined wall 42-1 that is the closest to the edge 13 in FIG. 1.

In an embodiment that is preferred on industrial and economic grounds, for ease of fabrication and for reliability of the bollard, the cartridge 42 is in the form of a housing that is substantially in the form of a rectangular parallelepiped or a circular cylinder, and that advantageously has an aluminum wall and is preferably of the honeycomb type.

For optimum operation of the barrier bollard when it is subjected to an impact, it is also advantageous for the second longitudinal axis 114 to be substantially perpendicular to the edge 13 of the wedge and for the barrier bollard to include means for guiding the sliding of the first block 10 relative to the second block 20 when the first block moves relative to the second block under the action of an impact applied to the oblong element 30, as represented by arrow Fi in FIG. 1.

In a preferred embodiment, these means for guiding the sliding movement of the first block 10 relative to the second block 20 are constituted by two slideways 71 and 72 mounted in cooperation with the two blocks, being situated on either side of a midplane containing the first longitudinal axis 31 of the oblong element 30 and perpendicular to the edge 13 of the wedge, advantageously symmetrically relative to said midplane, the midplane being constituted, for example, by the section plane of FIG. 1, these two slideways defining a sliding direction Dg that is substantially parallel to the second longitudinal axis 114 (FIG. 5).

In a possible embodiment, at least one of the two slideways 71 and 72, and preferably both of them as shown in FIGS. 2 to 5, is constituted by a female part 74 having a longitudinal slot 76 opening out into the side wall of the female part, and a male part 78 in the form of a lug, the cross-section of the lug 78 being substantially complementary to the cross-section of the longitudinal slot 76 so as to be suitable for traveling over at least a fraction of the length of the longitudinal slot 76.

Advantageously, it is also preferable for the female and male parts 74 and 78 to be secured respectively to the second block 20 and to the first block 10, as in the embodiment shown.

In preferred manner, and as shown more particularly in FIGS. 2, 3, and 5, the bollard of the invention further includes at least one channel 110 made in the face 22 of the second block 20 arranged as the sliding face 22', this channel being made in a direction parallel to the direction of the second longitudinal axis 114.

For improved operation of the bollard, as shown in FIG. 5, the bollard most advantageously has two channels 110 situated respectively on either side of the groove 52.

The bollard also includes at least one hook 100, shown in dashed lines in FIGS. 2 and 3, the hook being secured to the first block 10 to project from its second face 12 and being situated at a distance remote from the edge 13, towards a portion of the block 10 that is opposite from the portion including the edge 13. The hook is also arranged on the face 12 in such a manner as to be suitable for penetrating into the channel 110 and for traveling along a nonzero distance when the two blocks 10 and 20 are mounted in sliding cooperation, one on the other.

The bollard also includes an abutment 120 made in the channel 110, preferably close to the end of said channel that is situated close to the edge 13.

Such an abutment may be made in various ways. For example, it may be constituted by a vertical end wall of the channel. Nevertheless, and as shown, it is advantageously constituted by a bar or the like embedded in the second block 20 and extending across the channel 110.

Like the above-defined barrier, the abutment 120 is also arranged to co-operate with the channel 110 so as to catch the hook 100, i.e. so as to retain it as shown in FIG. 3, when the first block 10 has slid over the second block 20 under the action of an impact Fi, FIG. 1, applied to the oblong element 30, firstly in order to stop the first block sliding relative to the second block, and secondly, optionally, in order to encourage tilting of the first block at the end of its stroke, by means of a notch 130, FIGS. 3 and 5.

This tilting has the effect of absorbing an additional fraction of the energy of the impact against the oblong body 30, and also of further raising the portion of the block 10 that receives the front of the vehicle, as in the application shown in FIG. 3, and thus of moving the front of the vehicle Ve even further, should that the necessary, from the surface of the ground so that the front wheels Ro are sure to be hanging in the air, as explained below.

The operation of the barrier bollard of the invention as described above is substantially the same as that described in the French patent application in the name of the applicant as mentioned in the introduction, and is not described in greater detail herein, for the purpose merely of simplifying the present description.

Nevertheless, it is specified that the second block 20 is buried in the ground So and is fastened thereto, as shown in FIG. 3, by any means, where necessary with stakes or the like, or else it is cast in a concrete slab, etc., and in such a manner that when the bollard is in its "initial" configuration, i.e. prior to an impact, as shown in FIGS. 1, 2, and 4, the first face 11 of the first block lies substantially in the same plane as the surface of the ground So.

When the bollard is subjected to an impact Fi against the oblong element 30 that projects beyond the ground So, the first block 10 is caused to move by sliding on the second block 20 in order to take up a position of the kind shown in FIGS. 3 and 5.

It is emphasized that when the impact is caused by a vehicle Ve, FIG. 3, the vehicle may have its front portion resting on the first block 10, since by moving, this block moves upwards and leaves behind it a ditch Fo. This has the consequence of leaving the front wheels Ro of the vehicle Ve (usually the driving wheels) in the air, thereby immobilizing the vehicle, which is an advantage in the event of an attack by means of a battering-ram vehicle. Under such circumstances, the vehicle remains stuck in place and cannot be removed for thorough destruction in some other location, in particular in order to avoid leaving clues about the identity of the perpetrators of the attack.

Furthermore, when the first block 10 moves relative to the second block 20, the first block 10 is guided by the two slideways 71 and 72.

In the first above-described embodiment of the coupling means as shown in FIG. 1, during this movement, the groove 51 moves relative to the other groove 52 along the longitudinal axis 114, thereby compressing the aluminum cartridge 42 since it is sandwiched via its two ends 42-1, 42-2 between the two opposite side walls of the two grooves.

In the second and third embodiments of the coupling means, when the first block 10 moves by sliding on the second block 20, e.g. passing from its position Po to its position Pi, FIG. 1, the cartridge is deformed and compressed by being sandwiched between the tab and an edge of the groove.

One of the possible positions for the first block 10 after an impact Fi against the oblong body 30, relative to the second block 20 that remains stationary since it is embedded in the ground So, is shown in dashed lines under the reference Pi, while the initial position of the block 10 is shown in continuous lines under the reference Po.

In FIG. 1, dashed lines show the flattened cartridge 42 with its walls crumpled concertina-like, for example, after absorbing an impact as explained above.

The energy used for flattening the aluminum box together with the energy that is absorbed to lift the block 10 by sliding it relative to the block 20 from its position Po to its position Pi along arrow Fel (see the explanation in the Applicant's French patent application mentioned in the introduction of the present description), enables the impact Fi to be damped progressively, thereby achieving even more reliably the objects of the invention as mentioned in the introduction of the present description.

When the bollard of the invention includes one or more hooks 100, one or more channels 110, and one or more abutments 120, as described above, the sliding movement of the first block 10 over the second block 20 under the effect of an impact Fi against the oblong element 30 is damped by:

i) the friction forces of the two sliding faces 12' and 22' one on the other;

ii) the energy absorbed when it rises up the ramp constituted by the sliding face 22' of the second block 20;

iii) the flattening of the cartridge 42; and iv) the tilting on the top of the second block 20 when the hook 100 catches against the abutment 120, it being observed that this tilting is encouraged by the curved notch 130 formed in the second face 12 of the first block 10.

It should also be emphasized that with the hook 100 cooperating with the abutment 120 at the end of the sliding stroke of the first block 10 on the second block 20, the two blocks do not separate from each other, thereby facilitating a potential return to the initial configuration of the bollard, e.g. with the help of a hoist or the like, after a new cartridge 42 has been put into place.

On reading the above description, it can readily be seen that compared with prior art bollards, in particular the prior art bollard described in the above referenced French patent application, the barrier type bollard of the present invention may be of smaller dimensions and requires less material for making the two blocks. It is also less heavy and thus easier to transport to the location where it is to be installed, while nevertheless not being movable manually.

These advantages clearly contribute to a low overall cost for the bollard of the invention.

The invention claimed is:

1. A barrier type bollard, comprising:

a first block (10), the first block (10) being defined substantially between first and second faces (11, 12) defining a wedge with a dihedral angle having a value of less than ninety degrees, the first face (11) being defined substantially in a first plane (15), the second face (12) being arranged as a first sliding face (12') occupying a cylindrical surface (14);

a second block (20), the second block (20) having a face (22) arranged as a second sliding face (22') occupying a cylindrical surface (24) that is substantially complementary to the cylindrical surface (14) of the first block (10), the first and second blocks (10, 20) being mounted in sliding cooperation one on the other in such a manner that the first and second sliding faces (12', 22') rest one on the other;

an oblong element (30) defined along a first longitudinal axis (31);

means (35) for securing said oblong element (30) to project from the first face (11) of the first block (10) in such a manner that its longitudinal axis (31) forms a non-zero angle relative to the first plane, which angle is optionally ninety degrees;

damper means (40) for damping the sliding movement of the two blocks one on the other, said damper means being interposed between said two blocks, said damper means (40) being irreversible and constituted by at least one cartridge (42) having a deformable wall (44), and further comprising i) a groove extending along a second longitudinal axis (114) in one of the two blocks (10, 20) in which the groove is made, and opening out into one of the first and second sliding faces (12', 22') corresponding to the one of the two blocks, said groove being defined in such a manner that the cartridge (42) is suitable for being engaged therein, and ii) means for coupling a wall (42-2; 42-1) of said cartridge (42) perpendicular to said second longitudinal axis (114) when said cartridge is engaged in the groove with a one of the two blocks in which said groove is not made, said cartridge (42) being in the form of a box having an aluminum wall, and presenting substantially one of the following shapes: a rectangular parallelepiped, a circular cylinder;

at least one channel (110) made in the second sliding face (22') in a direction parallel to the direction of the second longitudinal axis (114);

at least one hook (100) secured to the first block (10) projecting from the second face (12) and situated at a distance spaced apart from the edge (13) in such a manner as to be suitable for plunging into said channel (110) and for running along said channel (110) over a nonzero distance when the first and second blocks (10, 20) are mounted in sliding cooperation one on the other; and an abutment (120) made in the channel close to the end of said channel (110) situated. close to said edge (13), said abutment (120) being arranged in cooperation with said channel (110) so as to catch said hook (100) when said first block has slid over the second block under the action of an impact (Fi) applied to the oblong element (30) in order to stop the sliding of the first block (10) relative to the second block (20).

2. The bollard according to claim 1, wherein said second longitudinal axis (114) is substantially perpendicular to the edge (13) of said wedge.

3. The bollard according to claim 2, further comprising:

means for guiding the sliding of the first block (10) relative to the second block (20) when the first block moves relative to the second block under the action of an impact (Fi) applied against the oblong element (30).

4. The bollard according to claim 1, further comprising:

means for guiding the sliding of the first block (10) relative to the second block (20) when the first block moves relative to the second block under the action of an impact (Fi) applied against the oblong element (30).

5. The bollard according to claim 4, wherein the means for guiding the sliding of the first block (10) relative to the second block (20) are constituted by two slideways (71, 72) mounted to co-operate with the two blocks, being situated on either side of a midplane containing said first longitudinal axis (31) and perpendicular to the edge (13) of the dihedral, the two slideways defining a sliding direction (Dg) that is substantially parallel to said second longitudinal axis (114).

6. The bollard according to claim 5, wherein at least one of the two slide ways (71, 72) is constituted by a female part (74) including a longitudinal slot (76) opening into the side wall of said female part, and a male part (78) forming a lug of cross-section substantially complementary to the cross-section of said longitudinal slot (76) so that the lug is suitable for moving along at least a fraction of the length of said slot.

7. The bollard according to claim 1, wherein said cartridge is in the form of a box having an aluminum wall of honeycomb structure.

8. The bollard according to claim 1, wherein said abutment (120) is arranged facilitate tilting of the first block at the end of its stroke.

9. A barrier type bollard comprising:

a first block (10), the first block (10) being defined substantially between first and second faces (11, 12) defining a wedge with a dihedral angle having a value of less than ninety degrees, the first face (11) being defined substantially in a first plane (15), the second face (12) being arranged as a first sliding face (12') occupying a cylindrical surface (14);

a second block (20), the second block (20) having a face (22) arranged as a second sliding face (22') occupying a cylindrical surface (24) that is substantially complementary to the cylindrical surface (14) of the first block (10), the first and second blocks (10, 20) being mounted in sliding cooperation one on the other in such a manner that the first and second sliding faces (12', 22') rest one on the other;

an oblong element (30) defined along a first longitudinal axis (31);

means (35) for securing said oblong element (30) to project from the first face (11) of the first block (10) in such a manner that its longitudinal axis (31) forms a non-zero angle relative to the first plane, which angle is optionally ninety degrees;

damper means (40) for damping the sliding movement of the two blocks one on the other, said damper means being interposed between said two blocks, said damper means (40) being irreversible and constituted by at least one cartridge (42) having a deformable wall (44), and further comprising i) a groove extending along a second longitudinal axis (114) in one of the two blocks (10, 20) in which the groove is made, and opening out into one of the first and second sliding faces (12', 22') corresponding to the one of the two blocks, said groove being defined in such a manner that the cartridge (42) is suitable for being engaged therein, and ii) means for coupling a wall (42-2; 42-1) of said cartridge (42) perpendicular to said second longitudinal axis (114) when said cartridge is engaged in the groove with a one of the two blocks in which said groove is not made, said second longitudinal axis (114) being substantially perpendicular to the edge (13) of said wedge;

at least one channel (110) made in the second sliding face (22') in a direction parallel to the direction of the second longitudinal axis (114);

at least one hook (100) secured to the first block (10) projecting from the second face (12) and situated at a distance spaced apart from the edge (13) in such a manner as to be suitable for plunging into said channel (110) and for running along over a nonzero distance when the two blocks (10, 20) are mounted in sliding cooperation one on the other; and an abutment (120) made in the channel close to the end of said channel (110) situated close to said edge (13), said abutment (120) being arranged in cooperation with said channel (110) so as to catch said hook (100) when said first block has slid over the second block under the action of an impact (Fi) applied to the oblong element (30) in order to stop the sliding of the first block (10) relative to the second block (20).

10. The bollard according to claim 9, wherein said abutment (120) is arranged facilitate tilting of the first block at the end of its stroke.

11. A barrier type bollard comprising:

a first block (10), the first block (10) being defined substantially between first and second faces (11, 12) defining a wedge with a dihedral.angle having a value of less than ninety degrees, the first face (11) being defined substantially in a first plane (15), the second face (12) being arranged as a first sliding face (12') occupying a cylindrical surface (14);

a second block (20), the second block (20) having a face (22) arranged as a second sliding face (22') occupying a cylindrical surface (24) that is substantially complementary to the cylindrical surface (14) of the first block (10), the first and second blocks (10, 20) being mounted in sliding cooperation one on the other in such a manner that the first and second sliding faces (12', 22') rest one on the other;

an oblong element (30) defined along a first longitudinal axis (31);

means (35) for securing said oblong element (30) to project from the first face (11) of the first block (10) in such a manner that its longitudinal axis (31) forms a non-zero angle relative to the first plane, which angle is optionally ninety degrees;

damper means (40) for damping the sliding movement of the two blocks one on the other, said damper means being interposed between said two blocks, said damper means (40) being irreversible and constituted by at least one cartridge (42) having a deformable wall (44), and further comprising i) a groove extending along a second longitudinal axis (114) in one of the two blocks (10, 20) in which the groove is made, and opening out into one of the first and second sliding faces (12', 22') corresponding to the one of the two blocks, said groove being defined in such a manner that the cartridge (42) is suitable for being engaged therein, and ii) means for coupling a wall (42-2; 42-1) of said cartridge (42) perpendicular to said second longitudinal axis (114) when said cartridge is engaged in the groove with a one of the two blocks in which said groove is not made;

means for guiding the sliding of the first block (10) relative to the second block (20) when the first block moves relative to the second block under the action of an impact (Fi) applied against the oblong element (30);

at least one channel (110) made in the face (22) of the second block (20) that is arranged as a sliding face (22') in a direction parallel to the direction of the second longitudinal axis (114);

at least one hook (100) secured to the first block (10) projecting from its second face (12) and situated at a distance spaced apart from the edge (13) in such a manner as to be suitable for plunging into said channel (110) and for running along over a nonzero distance when the two blocks (10, 20) are mounted in sliding cooperation one on the other; and an abutment (120) made in the channel close to the end of said channel (110) situated close to said edge (13), said abutment (120) being arranged in cooperation with said channel (110) so as to catch said hook (100) when said first block has slid over the second block under the action of an impact (Fi) applied to the oblong element (30) in order to stop the sliding of the first block (10) relative to the second block (20).

12. The bollard according to claim 11, wherein said abutment (120) is arranged facilitate tilting of the first block at the end of its stroke.

* * * * *